United States Patent [19]

Berle et al.

[11] 4,011,079

[45] Mar. 8, 1977

[54] METHOD FOR PRODUCING AN ELECTROPHOTOGRAPHIC RECORDING MATERIAL

[75] Inventors: Johannes Berle, Ruthen; Hartmut Dülken, Belecke; Gottfried Guder, Belecke; Karl-Heinz Kassel, Belecke, all of Germany

[73] Assignee: Licentia Patent-Verwaltungs-G.m.b.H., Frankfurt am Main, Germany

[22] Filed: Aug. 1, 1974

[21] Appl. No.: 493,889

[30] Foreign Application Priority Data

Aug. 2, 1973 Germany ..... 2339115

[52] U.S. Cl. ..... 96/1.5; 427/76; 427/248 R; 427/383 R

[51] Int. Cl.[2] ..... G03G 5/04

[58] Field of Search ..... 96/1.5; 29/572; 427/76, 427/248, 383

[56] References Cited

UNITED STATES PATENTS

| | | | |
|---|---|---|---|
| 2,833,675 | 5/1958 | Weimer | 117/201 |
| 2,886,434 | 5/1959 | Owens | 96/1.5 |
| 3,041,166 | 6/1962 | Bardeen | 96/1.5 |
| 3,174,855 | 3/1965 | Gray | 96/1.5 |
| 3,312,548 | 4/1967 | Straughan | 96/1.5 |
| 3,532,496 | 10/1970 | Chiang et al. | 96/1.5 |
| 3,634,134 | 1/1972 | Trubisky et al. | 96/1.5 |
| 3,697,265 | 10/1972 | Teuscher et al. | 96/1.5 |

OTHER PUBLICATIONS

Jour. Optical Soc., Keck, vol. 42, No. 4, Apr. 1952, pp. 221–225.

*Primary Examiner*—David Klein
*Assistant Examiner*—Judson R. Hightower
*Attorney, Agent, or Firm*—Spencer & Kaye

[57] ABSTRACT

In the fabrication of an electrophotographic recording material of the type composed of selenium, selenium compounds, or alloys with selenium, the method is simplified by initially vapor-depositing the photoconductive recording material onto a carrier at a temperature below the glass transformation temperature, and then heating the recording material to a higher second temperature range between the glass transformation temperature and a temperature just below that at which the electrophotographic properties of the recording material begin to change.

12 Claims, No Drawings

METHOD FOR PRODUCING AN ELECTROPHOTOGRAPHIC RECORDING MATERIAL

BACKGROUND OF THE INVENTION

The present invention relates to a method for producing an electrophotographic recording material of the type composed of selenium, selenium compounds, or alloys with selenium applied to a conductive carrier if required via an intermediate layer.

Electrophotographic methods and apparatus to practice such methods are widely used in the reproduction art. They utilize the property of such photoconductive material whereby its electrical resistance changes when it is exposed to activating radiation.

By electrically charging a photoconductive layer and then exposing it to such activating radiation in a pattern determined by an optical image, it is possible to produce thereon a latent electrical charge image which corresponds to the optical image. At the exposed points there occurs such an increase in the conductivity of the photoconductive layer that a part or substantially all of the electrical charge can flow off through the conductive carrier while at the unexposed points the electrical charge remains substantially unchanged. More precisely, the quantity of charge flowing off is greater at the exposed points than at the unexposed points. The latent image can be made visible with a picture powder, a so-called toner, and the resulting toner image can finally be transferred to paper or some other medium, if this should be required.

Organic as well as inorganic substances are used as the electrophotographically active substances. Among them, selenium, alloys with selenium and selenium compounds have gained particular importance.

The conductive carriers preferably are made of aluminum or aluminum alloys.

In order to obtain an electrophotographic recording material of high quality it is required, to vapor-deposit the photoconductive layer on the carrier at a temperature above the glass transformation temperature. This is the opinion of experts in the art (Bixby, U.S. Pat. No. 2,970,906; Felty, New Photoconductors for Xerography, Reprographie II, II. Internationaler Kongress, Cologne 1967, Verlag Dr. O. Helwich, Darmstadt und Wien, 1969; John H. Dessauer and Harold E. Clark, Xerography and Related Processes, The Focal Press, London and New York; R. M. Schaffert, Electrophotography, The Focal Press, London and New York) and, according to the generally known and accepted state of the art. This produces better wetting of the substrate surface, better layer structure, and better surface quality of the photoconductive layer due to less flaws. At the same time a reduction in the potential and an increase in the electrical resistance of the photoconductor can be noted. It should be noted that the "transformation temperature" of glass is defined as being that temperature at which glass has a viscosity of $10^{13.4}$ poises.

In the application of the above-mentioned teaching the vapor-deposition temperatures for pure selenium, for example, should be above about 50° C. For photoconductive layers which contain arsenic in addition to selenium and have higher glass transformation temperatures, the vapor-deposition temperatures must be selected correspondingly higher according to this teaching. With a content of 1 percent by weight arsenic, this temperature should be higher than 55 to 60° C, with 2 percent by weight arsenic this temperature should be higher than 60° to 65° C, with 38.7 percent by weight arsenic ($As_2Se_3$), the temperature should be higher than 180° C.

In such methods, where the vapor-deposition temperature lies above the glass transformation temperature, there is the drawback that a substantial amount of apparatus is required to transfer the required heat to the substrate, heat the substrate to the required temperature, and control and regulate the maintaining of this temperature, all during vacuum deposition.

At high vapor-deposition temperatures there appears the further drawback that only part of the material used as the photoconductor adheres to the surfaces of the conductive carrier intended to be coated; the remainder of the vapor-deposited photoconductive material is deposited on the walls of the apparatus. This results in rapid soiling of the apparatus thereby requiring additional cleansing steps. Also, a not insignificant loss of valuable photoconductor material occurs, and, after it is removed from the apparatus it no longer meets the high purity requirements. Due to this phenomenon, called the "re-evaporation rate", the consumption of photoconductive material is much higher than it should be according to the quantity actually deposited. This is particularly noticeable, for example, with arsenic selenide ($As_2Se_3$) which has a rather high glass transformation temperature, above 180° C, and when this material is used a substantially larger amount of photoconductor material is always consumed.

SUMMARY OF THE INVENTION

It is an object of the present invention to eliminate these drawbacks. More specific objects of the present invention are to reduce the large amount of apparatus required for vapor-depositing the photoconductive layer, to keep losses of photoconductive material during the vapor-deposition process as low as possible, and to avoid soiling the apparatus without impairing the electrophotographic properties of the vapor-deposited layers.

These and other objects according to the present invention are accomplished in a method for producing an electrophotographic recording material of selenium, selenium compounds, or alloys with selenium which is applied to a conductive substrate. If required this is accomplished via an intermediate layer. A photoconductive layer is initially applied to the conductive substrate at a low temperature range and then is subjected to thermal treatment at a higher temperature range whose lower limit is defined by the glass transformation temperature of the photoconductive layer and whose upper limit is defined by a temperature at which the electrophotographic properties of the photoconductive layer are not yet changed.)

The higher temperature limit is clearly below the melting point, which for selenium is 220° C and for $As_2Se_3$ 360° C. For arsenic and selenium systems with compositions between Se and $As_2Se_3$ the melting points lay between the stated temperatures. The higher temperature limit is moreover determined so that in the applied temperature range crystallisation is not allowed to occur.

For pure selenium at temperatures over 100° C the speed of crystallisation is of consequence. Pure selenium should therefore not be heated above 100° C. For $As_2Se_3$ the speed of crystallisation is less so during a shorter time, sufficient for the execution of the invention, temperatures over 300° C can also be used. Temperatures and times must be harmonized corresponding to speeds of crystallisation of different materials.

DESCRIPTION OF THE PREFERRED EMBODIMENTS

The method according to the invention provides that the process step of vapor-depositing can be effected at room temperature, or at only a slightly higher temperature, so that heat transfer and temperature control and regulation, which are rather difficult to accomplish in a vacuum apparatus, can be eliminated. Since heating devices are unnecessary the vacuum apparatus thus becomes much less expensive so that all vapor-deposited layers can be produced much simpler and less expensively. For the subsequent annealing step, which is effected at a higher temperature, it is no longer necessary to have a vacuum apparatus. Rather, heat input and heat removal can be realized in a simple and economical manner in a simple pass-through furnace whose temperature can be easily regulated. Compared to conventional processes, the quality of the electrophotographic properties is not impaired by the subsequent annealing step as long as a sufficiently low upper temperature limit is observed. For example, no crystallization must occur in selenium layers.

For such vapor-deposited layers which have a higher content of arsenic and which lately have gained greater and greater significance for practical application in electrophotographic processes, the process of the present invention provides a further advantage.

Since a higher vapor-deposition temperature is no longer required, which, due to the higher glass transformation temperature of the arsenic-containing selenium layer was considered necessary according to the known teachings, only a very low reevaporation rate is noted during the vapor-deposition process. This means that the apparatus will be soiled only slightly and the losses of valuable photoconductor material can be limited to small proportions. Thus, it is possible with the process of the present invention, for example, to reduce to one third the consumption of photoconductive material when arsenic selenide ($As_2Se_3$) is used compared to conventional methods with the same layer thickness. This results in a considerable savings in costs. Surprisingly, hardly any re-evaporation takes place during the annealing step which follows the vapor-deposition step, even at higher temperatures, compared to vapor-deposition at the same higher temperatures.

If it is intended to apply pure selenium onto planar plates or cylindrical drums, the selenium, which has a glass transformation temperature of about 30° C, is initially vapor-deposited at room temperature in a vacuum apparatus at a pressure of about $10^{-4}$ to $10^{-6}$ Torr on a substrate which has been prepared in the usual manner at a deposition rate of several $\mu$ per minute. In a second, separate process step the vapor-deposited layer is then tempered - advisably in a pass-through furnace - for a period of about 15 to 60 minutes at a temperature range of from 55° to 75° C. During the annealing process the pressure is preferably normal or slightly below or above atmospheric. If required, the annealing can advantageously be effected in a protective gas atmosphere, for example, in nitrogen and/or argon.

If selenium and small portions of arsenic are vapor-deposited, the vapor-deposition temperatures lie in approximately the same range. Corresponding to the higher glass transformation temperatures, a higher annealing temperature of from 60° to 95° C is selected for 1% arsenic, a annealing temperature of from 65° to 110° C is selected for 2% arsenic. With arsenic contents of from 0.5 to 5% arsenic the upper limit of the temperature range may lie at temperatures over 150° C because the danger of crystallization of the amorphous selenium layer no longer exists.

If selenium and a large amount of arsenic, for example arsenic selenide ($As_2Se_3$) are to be vapor-deposited onto a cylindrical drum, vapor-deposition temperatures between 0 and 100° C, preferably between 18° and 25° C are selected. The pressure conditions and vapor-deposition rates correspond to the above-mentioned example. In the immediately following annealing step which, as mentioned above, is advisably effected in a pass-through furnace, the vapor-deposited layer is kept at a temperature of more than 180° C for a duration of about 15 to 60 minutes, preferably in a temperature range between 200° and 250° C. A complete range of examples is given for various percentages of arsenic together with the various temperature ranges in the following table:

| Material | Preferred post-annealing temperature range | Preferred post-annealing period | Approximate maximum temperature for post-annealing |
|---|---|---|---|
| Se | 55 – 75° C | 15 – 90 min | 100° C |
| Se + 1 % As | 60 – 95° C | 15 – 90 min | 120° C |
| Se + 2 % As | 65 – 110° C | 15 – 90 min | 130° C |
| Se + 5 % As | 75 – 120° C | 15 – 90 min | 150° C |
| Se + 10 % As | 90 – 170° C | 15 – 90 min | 180° C |
| Se + 20 % As | 120 – 190° C | 15 – 90 min | 215° C |
| Se + 30 % As | 140 – 200° C | 15 – 90 min | 250° C |
| Se + 38,7 % As | 200 – 250° C | 15 – 90 min | 300° C |

It will be understood that the above description of the present invention is susceptible to various modifications, changes and adaptations, and the same are intended to be comprehended within the meaning and range of equivalents of the appended claims.

Reference is hereby made to the application of Beschoner et al, Serial No. 442,319, filed in the U.S. Pat. Office on Feb. 14, 1974, now abandoned, for *METHOD FOR PRODUCING AN ELECTROPHOTOGRAPHIC RECORDING MATERIAL*, and to the application of Hans-Hermann Beschoner, Gottfried Guder, Hartmut Dulken and Karl-Heinz Kassel for ELECTROPHOTOGRAPHIC IMAGE CARRIER AND METHOD OF MAKING SAME, corresponding to German application P 23 37 386.6 filed in Germany on July 23rd, 1973, and copending herewith, the disclosures of which applications are hereby incorporated herein in their entirety.

We claim:

1. A method for producing an amorphous electrophotographic recording material of selenium, selenium compounds, or alloys with selenium, wherein the selenium, selenium compounds, or alloys with selenium are present only in amorphous form, by depositing the recording material on a conductive carrier, comprising the steps of applying, by vapor depositing, a photoconductive layer on the conductive carrier at a first temperatuure range below the glass transformation temperature, and then heating the photoconductive layer on the conductive carrier at a higher second temperature range the lower limit of which is the glass transformation temperature of the photoconductive layer and the upper limit of which is the temperature just below that at which the electrophotographic properties begin to change.

2. A method as defined in claim 1 wherein an intermediate layer is first applied onto the conductive carrier and then the recording material is applied to the carrier via said intermediate layer.

3. A method as defined in claim 1 wherein the step of applying a photoconductive layer is performed at a pressure of about $10^{-4}$ to $10^{-6}$ Torr by vapor-deposition.

4. A method as defined in claim 1 wherein the photoconductive layer is applied at a deposition rate of several microns per minute.

5. A method as defined in claim 1 wherein the step of heating has a duration of about 15 to 60 minutes.

6. A method as defined in claim 1 wherein during the step of applying, a photoconductive layer of pure selenium is vapor-deposited in a temperature range of from about 18 to 25° C and during the step of heating the temperature range is about 55 to 75° C.

7. A method as defined in claim 1 wherein during the step of applying, a photoconductive layer containing about 0.5 to 5% arsenic is vapor-deposited at a temperature range of about 18° to 25° C and during the step of heating the temperature range is about 60° to 150° C.

8. A method as defined in claim 1 wherein during the step of applying, a photoconductive layer of arsenic selenide ($As_2Se_3$) is vapor-deposited at a temperature range of 0° to 100° C.

9. A method as defined in claim 1 wherein during the step of applying, a photoconductive layer of arsenic selenide ($As_2Se_3$) is vapor-deposited at a temperature range of 18° to 25° C.

10. A method as defined in claim 1 wherein during the step of heating, a photoconductive layer of arsenic selenide ($As_2Se_3$) is subjected to a thermal treatment at a temperature range above 180° C.

11. A method as defined in claim 1 wherein during the step of heating, a photoconductive layer of arsenic selenide ($As_2Se_3$) is subjected to a thermal treatment at a temperature range between 200 and 250° C.

12. A method as defined in claim 1 wherein a compound or alloy of selenium with arsenic is applied as the photoconductive layer.

* * * * *